US007818923B2

(12) United States Patent
Alvarez

(10) Patent No.: US 7,818,923 B2
(45) Date of Patent: Oct. 26, 2010

(54) TILE SPACER

(76) Inventor: David J. Alvarez, 15850 SW. Breccia Dr., Beaverton, OR (US) 97007

( * ) Notice: Subject to any disclaimer, the term of this patent is extended or adjusted under 35 U.S.C. 154(b) by 371 days.

(21) Appl. No.: 11/687,662

(22) Filed: Mar. 18, 2007

(65) Prior Publication Data

US 2007/0214743 A1 Sep. 20, 2007

Related U.S. Application Data

(60) Provisional application No. 60/783,296, filed on Mar. 17, 2006.

(51) Int. Cl.
*E04F 21/20* (2006.01)
*G01B 3/00* (2006.01)

(52) U.S. Cl. ..... 52/105; 52/749.11; 33/526; 33/527

(58) Field of Classification Search ..... 52/749.11, 52/105, 285.2, 585.1, 848; 33/526, 527, 33/501.45, 542, 567; D8/14, 354; D10/64; 446/124, 128; 81/849, 439, 461
See application file for complete search history.

(56) References Cited

U.S. PATENT DOCUMENTS 697,701 A * 4/1902 Ayer ..... 33/562
747,711 A * 12/1903 Hollingsworth ..... 434/211
802,402 A * 10/1905 Martin ..... 33/567
987,703 A * 3/1911 Curtin ..... 33/562
1,264,519 A * 4/1918 Hinson ..... 72/477
1,608,620 A * 11/1926 Robinson ..... 81/439
1,624,150 A * 4/1927 Scherer ..... 33/562
1,688,525 A * 10/1928 Cowart ..... 81/436
2,031,684 A * 2/1936 Berger ..... 52/396.1
2,297,569 A * 9/1942 Lloyd ..... 33/567
2,466,919 A * 4/1949 Sykes ..... 33/526
2,536,401 A * 1/1951 Victor ..... 33/567
2,861,388 A * 11/1958 Favaretto ..... 446/124
2,874,708 A * 2/1959 Daus, Jr. ..... 135/157
2,930,135 A * 3/1960 Rodtz, Sr. ..... 33/518
3,295,281 A * 1/1967 Dixon ..... 52/442
3,386,590 A * 6/1968 Gretz ..... 211/189
3,411,257 A * 11/1968 Yaremchuk ..... 52/415
3,417,475 A * 12/1968 Vlasaty ..... 33/502
3,461,631 A * 8/1969 Brugnola et al. ..... 52/606
3,711,133 A * 1/1973 Werner ..... 403/172
3,735,497 A * 5/1973 Boettcher ..... 33/526
3,771,232 A * 11/1973 Specht ..... 33/375
3,890,738 A * 6/1975 Bassani ..... 446/111
4,065,854 A * 1/1978 Reed ..... 33/567
4,084,344 A * 4/1978 Asano ..... 446/126
4,299,421 A * 11/1981 Bontrager ..... 296/26.05
D264,300 S * 5/1982 Imm ..... D8/28
4,495,670 A * 1/1985 Baker ..... 15/236.02
4,571,910 A * 2/1986 Cosentino ..... 52/391
D287,475 S * 12/1986 Jordan ..... D10/70
4,630,550 A * 12/1986 Weitzman ..... 108/155

(Continued)

FOREIGN PATENT DOCUMENTS

EP 1111157 A1 * 6/2001

(Continued)

*Primary Examiner*—Robert J Canfield
(74) *Attorney, Agent, or Firm*—Ganz Law, P.C.

(57) ABSTRACT

A tile spacer that provides multiple grout line and/or adjustment dimensions.

14 Claims, 10 Drawing Sheets

U.S. PATENT DOCUMENTS

D288,402 S * 2/1987 Bonbright ..... D8/14
4,654,919 A * 4/1987 Liberman ..... 15/245.1
4,673,308 A * 6/1987 Reilly ..... 403/172
4,691,818 A * 9/1987 Weber ..... 198/666
D294,470 S * 3/1988 Jordan ..... D10/64
4,774,793 A * 10/1988 Mayer ..... 52/308
4,793,068 A * 12/1988 Golkar ..... 33/526
4,850,114 A * 7/1989 Vockins ..... 33/526
D303,716 S * 9/1989 Waller ..... D8/354
4,862,668 A * 9/1989 DeGooyer ..... 52/747.11
4,893,970 A * 1/1990 Becraft ..... 408/72 R
4,903,354 A * 2/1990 Yeh ..... 5/53.1
4,908,952 A * 3/1990 Joos ..... 33/526
4,953,341 A * 9/1990 Joos ..... 52/747.11
4,955,142 A * 9/1990 Rieck ..... 33/526
5,010,654 A * 4/1991 Funes, Jr. ..... 33/526
D318,629 S * 7/1991 Michelson ..... D10/64
5,044,834 A * 9/1991 Janopaul, Jr. ..... 405/284
5,123,172 A * 6/1992 Thrun ..... 33/526
5,127,762 A * 7/1992 Havlovitz ..... 403/298
5,129,153 A * 7/1992 Burns, Sr. ..... 33/613
5,134,781 A * 8/1992 Baker ..... 33/502
5,161,918 A * 11/1992 Hodel ..... 405/286
5,191,718 A * 3/1993 Fox ..... 33/526
5,199,180 A * 4/1993 Yablonsky ..... 33/501.45
5,201,130 A * 4/1993 Krchnak ..... 33/526
5,257,880 A * 11/1993 Janopaul, Jr. ..... 405/284
5,288,534 A * 2/1994 Tavshanjian ..... 428/64.1
5,293,694 A * 3/1994 Swindle ..... 33/527
5,325,595 A * 7/1994 Marlin ..... 30/294
5,329,703 A * 7/1994 Craig ..... 33/567
5,465,929 A * 11/1995 Dooley ..... 248/68.1
5,471,759 A * 12/1995 Burrows et al. ..... 33/567
5,473,966 A * 12/1995 Cordon ..... 83/56
5,560,117 A * 10/1996 Tallman ..... 33/526
5,604,988 A * 2/1997 Costelloe ..... 33/501
5,623,799 A * 4/1997 Kowalski et al. ..... 52/392
D398,822 S * 9/1998 Webb ..... D8/14
D400,428 S * 11/1998 Sabounjian ..... D8/382
D415,669 S * 10/1999 Bolin ..... D8/51
6,115,983 A * 9/2000 Poignard ..... 52/606
6,131,620 A * 10/2000 Mette ..... 140/147
6,145,262 A * 11/2000 Schrader et al. ..... 52/396.02
D437,945 S * 2/2001 Mast et al. ..... D25/199
6,230,413 B1 * 5/2001 Reiley ..... 33/194
D443,501 S * 6/2001 Sleppy ..... D8/354
6,269,717 B1 * 8/2001 Bollinger ..... 81/177.2
D451,773 S * 12/2001 Stamback ..... D8/14
6,354,058 B1 * 3/2002 Lewis ..... 52/749.11
6,385,858 B1 * 5/2002 Muller ..... 33/526
6,405,494 B1 * 6/2002 Wismeth ..... 52/173.3
D462,018 S * 8/2002 Markle ..... D10/64
D470,385 S * 2/2003 Chen ..... D8/107
6,612,045 B2 * 9/2003 Kruskamp ..... 33/526
6,647,685 B2 * 11/2003 Annarella et al. ..... 52/392
6,688,017 B2 * 2/2004 Kao et al. ..... 33/645
6,769,191 B1 * 8/2004 Zusman ..... 33/526
D498,996 S * 11/2004 Parries ..... D8/14
6,823,640 B1 * 11/2004 Pytlewski ..... 52/677
6,862,815 B1 * 3/2005 Blouch ..... 33/562
6,874,242 B2 * 4/2005 Shilo et al. ..... 33/526
D509,305 S * 9/2005 Rosian ..... D25/135
6,973,735 B1 * 12/2005 Billiot ..... 33/526
7,111,435 B2 * 9/2006 Flores ..... 52/387
7,188,430 B2 * 3/2007 Tange ..... 33/544.4
D542,161 S * 5/2007 Skillings ..... D10/64
7,216,855 B2 * 5/2007 Platt ..... 256/65.03
7,475,488 B2 * 1/2009 Symington ..... 33/526
7,513,049 B2 * 4/2009 Williams ..... 33/42
7,524,130 B2 * 4/2009 Zenda et al. ..... 403/292
2002/0121027 A1 * 9/2002 Kruskamp ..... 33/526
2002/0148129 A1 * 10/2002 Donnellan ..... 33/526
2003/0159399 A1 * 8/2003 Werren ..... 52/749.1
2006/0144011 A1 7/2006 Symington
2006/0168900 A1 * 8/2006 Scarpine ..... 52/36.3
2007/0011898 A1 * 1/2007 Frank et al. ..... 33/526
2007/0227025 A1 * 10/2007 Venture ..... 33/527
2008/0141617 A1 * 6/2008 Joski ..... 52/749.11

FOREIGN PATENT DOCUMENTS

FR 2415702 A * 9/1979
GB 2334731 A * 9/1999
GB 2426027 A * 11/2006
GB 2439322 A * 12/2007
JP 04360959 A * 12/1992
JP 2002255245 A * 9/2002
WO WO 2004001159 A1 * 12/2003
WO WO2006072772 7/2006
WO WO 2006075180 A1 * 7/2006

* cited by examiner

TILE SPACER

CROSS REFERENCE TO RELATED APPLICATIONS

This application claims priority to and the benefit of U.S. of America provisional patent application No. 60/783,296, filed Mar. 17, 2006, entitled TILE SPACER, by David Alvarez, which is hereby incorporated by reference as if included herein in its entirety for all purposes.

BACKGROUND

The inventive subject matter disclosed herein relates to spacers used in the laying of tiles of all types.

Tile installers use items called tile spacers to separate tiles as they are being laid horizontally (e.g., flooring) and vertically (e.g., walls). A tile spacer is typically placed between two tiles as they are being attached to the surface with a bonding agent such as an adhesive or mortar. The objective is to maintain a grout line of uniform width between rows of tiles that will typically later be filled with grout. The tile spacers prevent the tiles from shifting or moving before the bonding agent cures, disrupting the grout line. Maintaining a grout line of uniform width and levelness is especially challenging when installing tiles on a vertical surface because gravity may cause tiles to shift downwardly from their initial position. It is also challenging to maintain even lines when working with certain tile materials, including stones, such as slate, that may have uneven surfaces. Irregular or unlevel horizontal or vertical grout lines on a finished job can ruin the look and quality of any tile installation. The effect of just one uneven row can be magnified into other rows causing unacceptable work.

Prior art tile spacers are cross-shaped (irregular dodecagons) devices typically made of a compressible rubber or plastic frame (See FIGS. 1A, 1B) (There are some non-compressible tile spacers; however, to maintain the ability for removal by hand, such spacers do not go into the grout line deep enough to maintain a grout line of uniform width). In a first plane that transects transversely all four arms, the cross-sectional width of all four arms is the same. Similarly, in a second or third plane, which is perpendicular to the first plane and that transects either pair of opposing arms, the cross-sectional width of a pair of arms is the same. (However, the width of the arms in a first plane capturing two opposing arms may not be the same as that in the second plane capturing the other two opposing arms). The corners of a tile are intended to be received between arms of the cross, as indicated in FIG. 1A. In the time span between tiling and grouting, these rubber tile spacers may become compressed by the weight of a tile. FIG. 1B demonstrates the compressibility of a conventional spacer. Compressed tile spacers can skew a grout line and may be more difficult to remove for grouting. Hundreds or even thousands of tile spacers can be used in a single job; therefore, if spacers are difficult to remove, there can be significant inefficiencies.

While most prior art tile spacers need to be pried out of the grooves using a separate hand tool, there is a type of plastic tile spacer (a frame in a cross shape) that is designed to remain in the grooves, but it of course cannot be reused, thus necessitating that installers repurchase spacers for future jobs.

Another challenge faced by installers is the need to provide grout lines of varying widths. For example, some jobs or portions of a job require very close grout lines that minimize the appearance of the grout, and others may require wide, conspicuous grout lines. Therefore, since prior art spacers are configured for a single size, installers must purchase multiple sets or spacers for each grout line width they may need and must go to the trouble of hunting for different size spacers while working.

An important feature of laying tile is the need to be able to make adjustments. Tiles are not perfectly dimensional for various reasons. A tile that is out-of-square, even by 1/16", requires adjustment. Sometimes tiles are square, but the dimensions vary. For example, one tile could be exactly 12", and another tile could be 1/16" different. Also, manufactured ceramic tiles may be stamped to be the same size, but slight variations in the size can occur during the firing process as tiles are heated and cooled. Stone tiles may have varying dimensions or irregularities because cutting processes are not perfect. Wavy and rounded tiles for aesthetics do exist. Such tiles need adjustments, and spacers are very helpful at creating such adjustments. Rounded or wavy tiles may also be out-of-square. So again, there can be variation in diameter in natural or manufactured stone, which calls for the need to adjust the grout line to compensate. As indicated above, the goal of the installer is to maintain as even of a grout line as possible. Previously, an installer only had the option of using an adjustment wedge along with a tile spacer to make such adjustments (FIG. 4). There is a need for easier adjustments that do not require multiple pieces.

In the view of the foregoing, there is a need for improved tile spacers that are easier and more efficient to use.

SUMMARY

The inventive subject matter described herein overcomes problems in the prior art by providing novel tile spacers with the following features, alone or in combination:

1. Tile spacers that are designed with portions of different predetermined dimensions so that a single spacer can be used to define multiple grout line widths or to make adjustments.
2. Tile spacers that are made out of a hard, non-compressing material that facilitates uniform and level grout lines.
3. Tile spacers that are easily removable by hand and are reusable.
4. Tile spacers that accept adjustment wedges more easily.

These and other embodiments are described in more detail in the following detailed descriptions and the figures.

The foregoing is not intended to be an exhaustive list of embodiments and features of the present inventive concept. Persons skilled in the art are capable of appreciating other embodiments and features from the following detailed description in conjunction with the drawings.

DETAILED DESCRIPTION

Figure 1A:
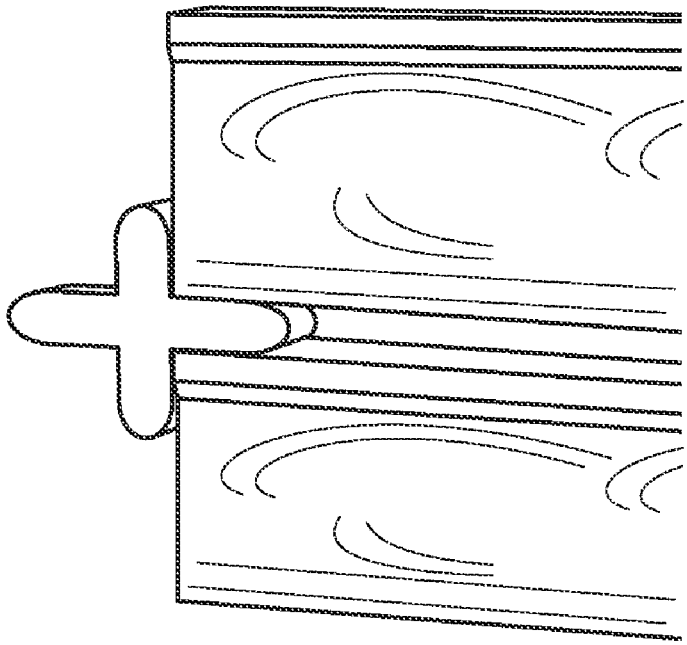
Fig. 1A (Prior Art)
FIGS. 1A and 1B show a prior art rubber tile spacer, which can become compressed under the weight of a tile or gravity.
Figure 1B:
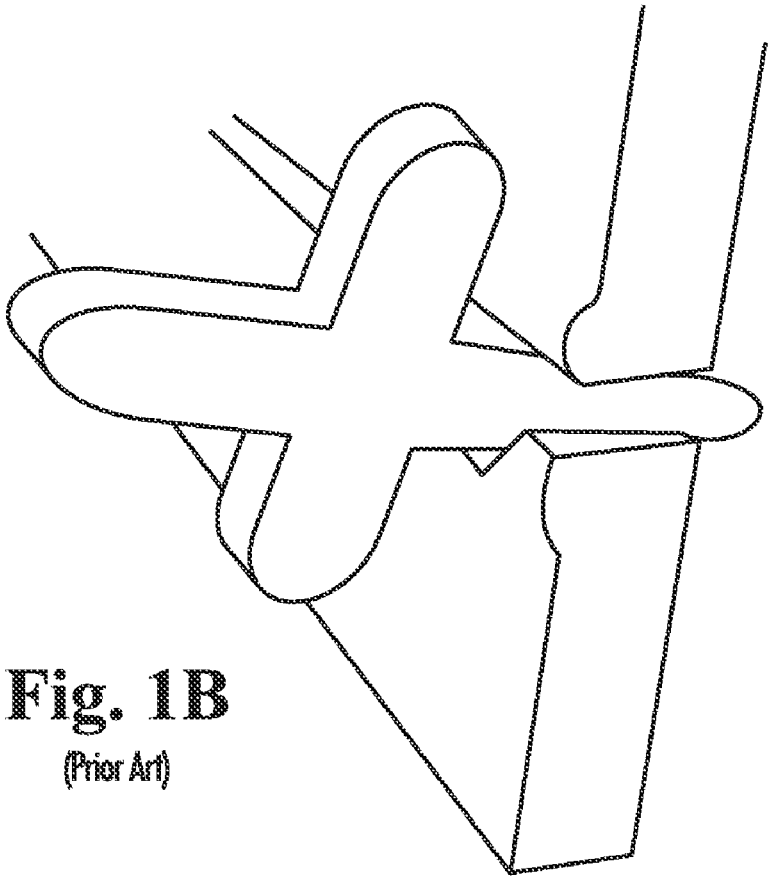
Fig. 1B (Prior Art)

Representative embodiments according to the inventive subject matter are shown in FIGS. 2-3, 5-14 wherein similar features share common reference numerals.

A tile spacer 10 according to the inventive subject matter includes a first arm 12 having a dimension A' defining a first predetermined width X for a grout line and a second 14 arm having a corresponding dimension A defining a second predetermined width for a grout line. The spacer is generally in the shape of an octahedron formed of two opposing quadrihedrons (See FIG. 7). In this embodiment the arms are disposed along a common axis. A horizontal plane transecting the spacer 10 through both arms would produce a cross-section generally in the form of an irregular octagon (e.g., top view, FIG. 9). Width A is different from A'; in this case A is larger. These two dimensions represent different predetermined grout line widths. In contrast, no plane that can transect through two or four arms of a prior art spacer will produce cross-sections of different widths so that opposing arms define different grout line widths. Further, a perpendicular plane through the arms of a spacer 10 (relative to the first plane) could produce a cross-section with widths B and B' (e.g., side view, FIG. 8), where B or B' do not equal each other and are different from A and A'. Accordingly, spacer 10, based on two opposing quadrilaterals can be configured to provide 2 to 4 grout line widths in a single piece. The linear nature of the spacer also facilitates finger manipulation for both insertion and removal. Each surface of a particular dimension may come with sensory indicia for its respective size. For example, colors, numbering, touch indentations or raised areas may be coded to grout line sizes.

The tile spacers according to the inventive subject matter are preferably made of a material that is sufficiently rigid to withstand compression by the tiles with which it is intended for use. For example, plastics, woods and metals may all provide sufficient rigidity. Fabrication of the spacers is well within the skill of persons in the art.

In addition to the two-arm configuration shown in the Figures, additional arms may be provided to form polyhedrons of various configurations. For example, the inventive subject matter may be implemented in a cross-shaped form wherein one or more arms has dimensions that differ from the other arms, making up to eight sizes possible given that each rectangular arm has two width dimensions, one being perpendicular to the other.

Figure 2:
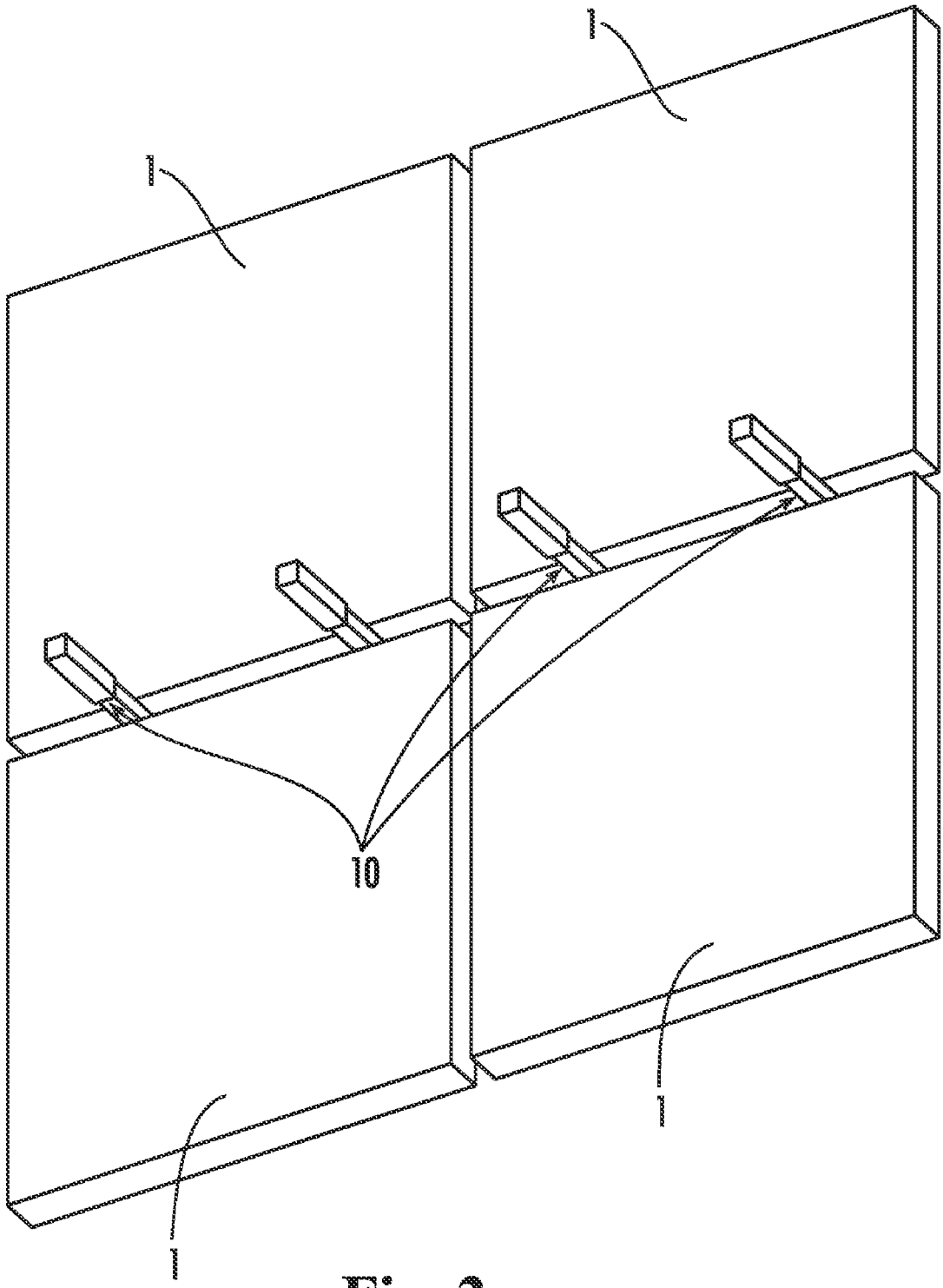
FIG. 2 is an example view of a tile spacer according to the inventive subject matter inserted between four tiles.
Figure 3A:
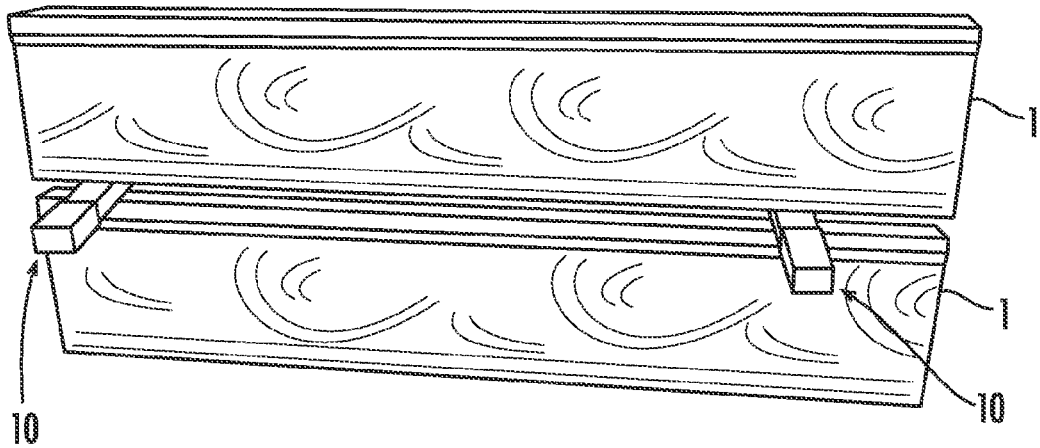
FIGS. 3A and 3B show front and side views of tile spacers in between tiles, according to the inventive subject matter.
Figure 3B:
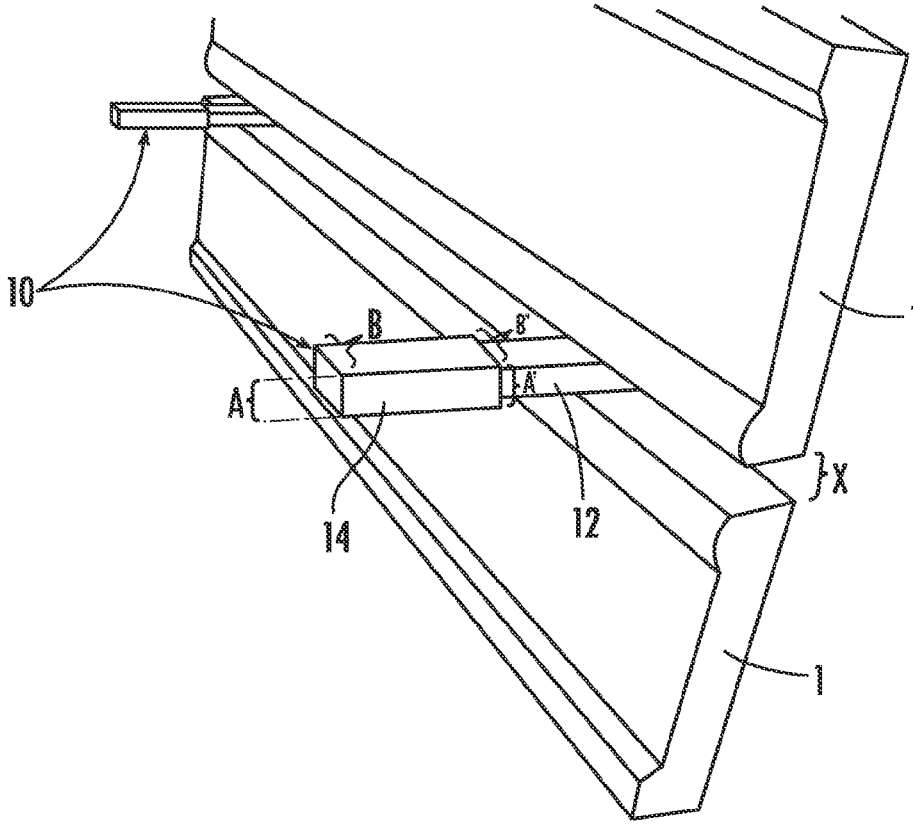
Figure 4:
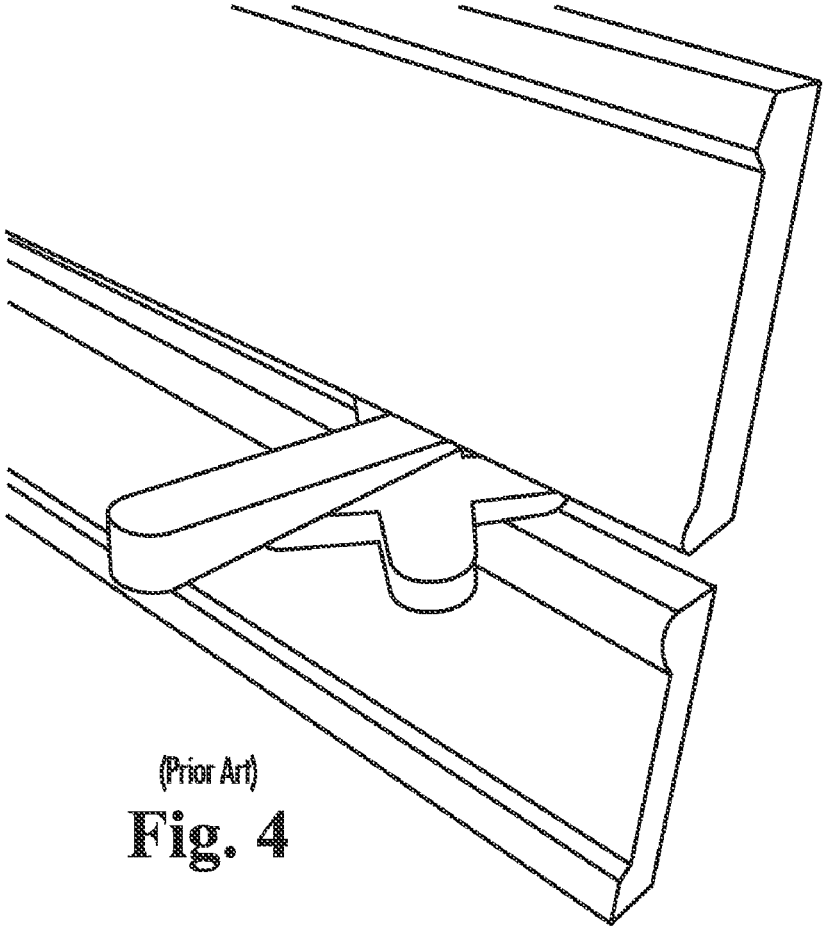
(Prior Art) Fig. 4
FIG. 4 shows a prior art tile spacer with a standard adjustment wedge.

A tile spacer according to the inventive subject matter is placed between two tiles 1 as they are being attached to a wall or other surface with adhesive or other bonding agent (FIGS. 2-3). Once the adhesive cures, the tile spacers are removed, and the grout is applied. Alternatively, in some applications grout need not be applied at all to the grout lines, or they could be in-filled with a substance other than grout.

Figure 5:
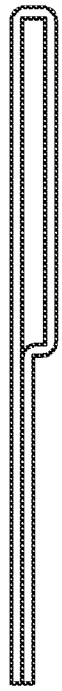
FIG. 5 shows a side view of one possible spacer according to the inventive subject matter.
Figure 6A:
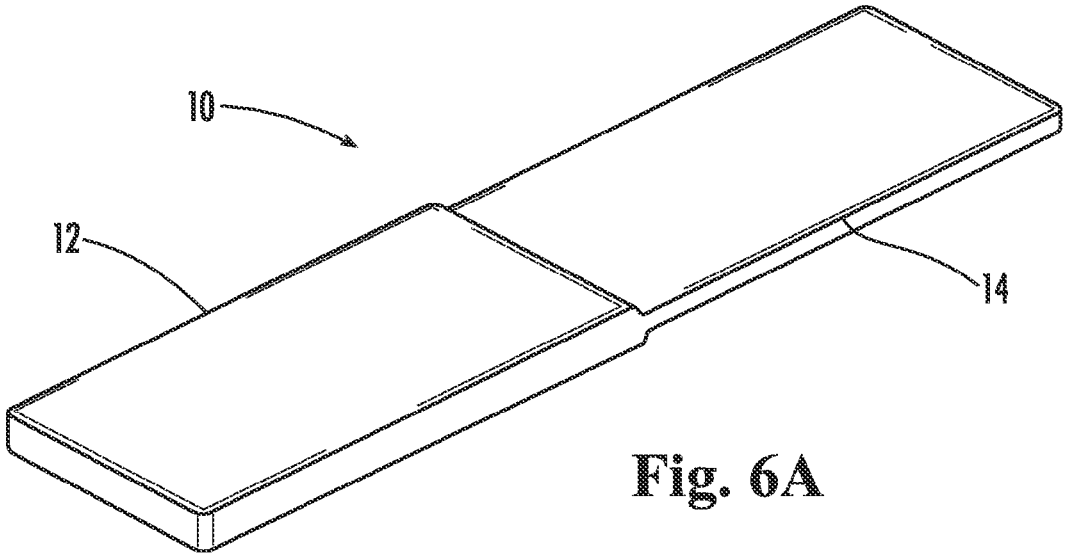
FIGS. 6A to 6C show perspective, top, and end views of a spacer according to the inventive subject matter.
Figure 6B:
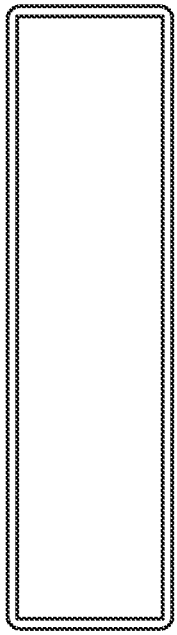
Figure 6C:
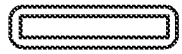
Figure 7:
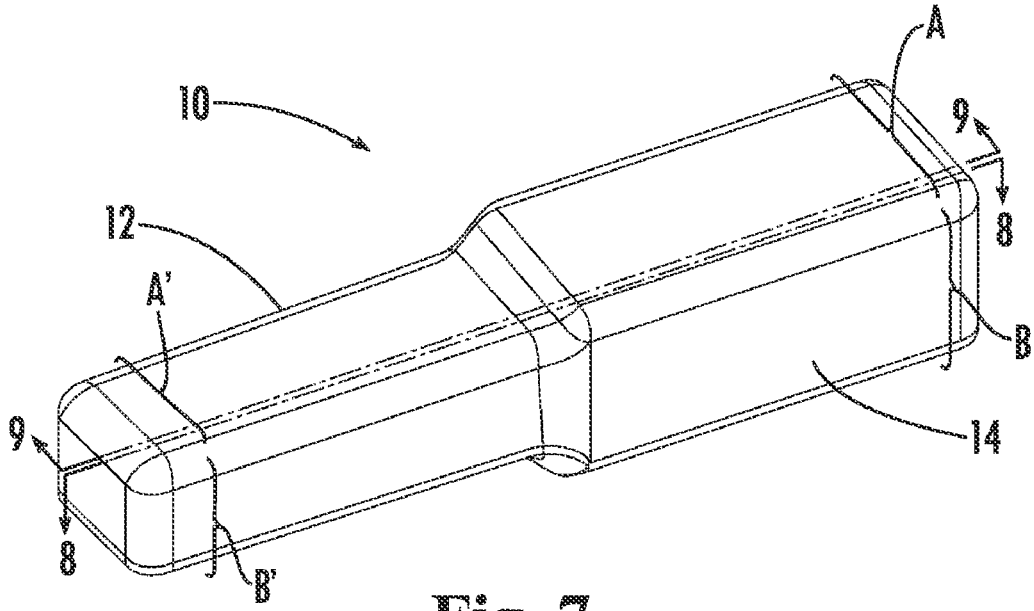
FIG. 7 shows a perspective view of a tile spacer according to the inventive subject matter.
Figure 9:
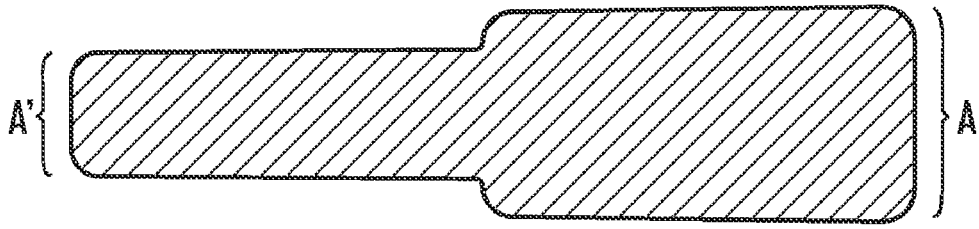
FIG. 9, shows a cross-section along line 9-9 in FIG. 7.
Figure 8:
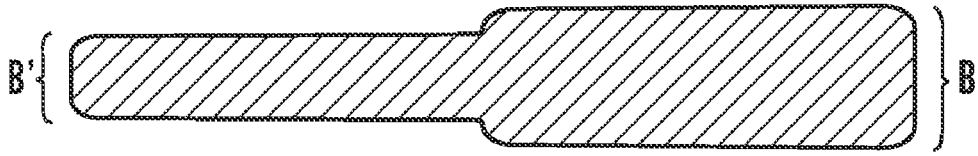
FIG. 8, shows a cross-section along line 8-8 in FIG. 7.

In the embodiment shown, each rectangular end of the inventive concept is a different width and the spacer may be turned on its side to utilize an additional width (FIG. 5). This variation allows the tile installer to choose from various sizes on one spacer to make adjustments. Contemplated spacer widths include 1/32", 1/16", 1/8", 3/16", or 1/4" and 5/16", 3/8", 1/2", or any other standard or custom sizing.

Figure 10:
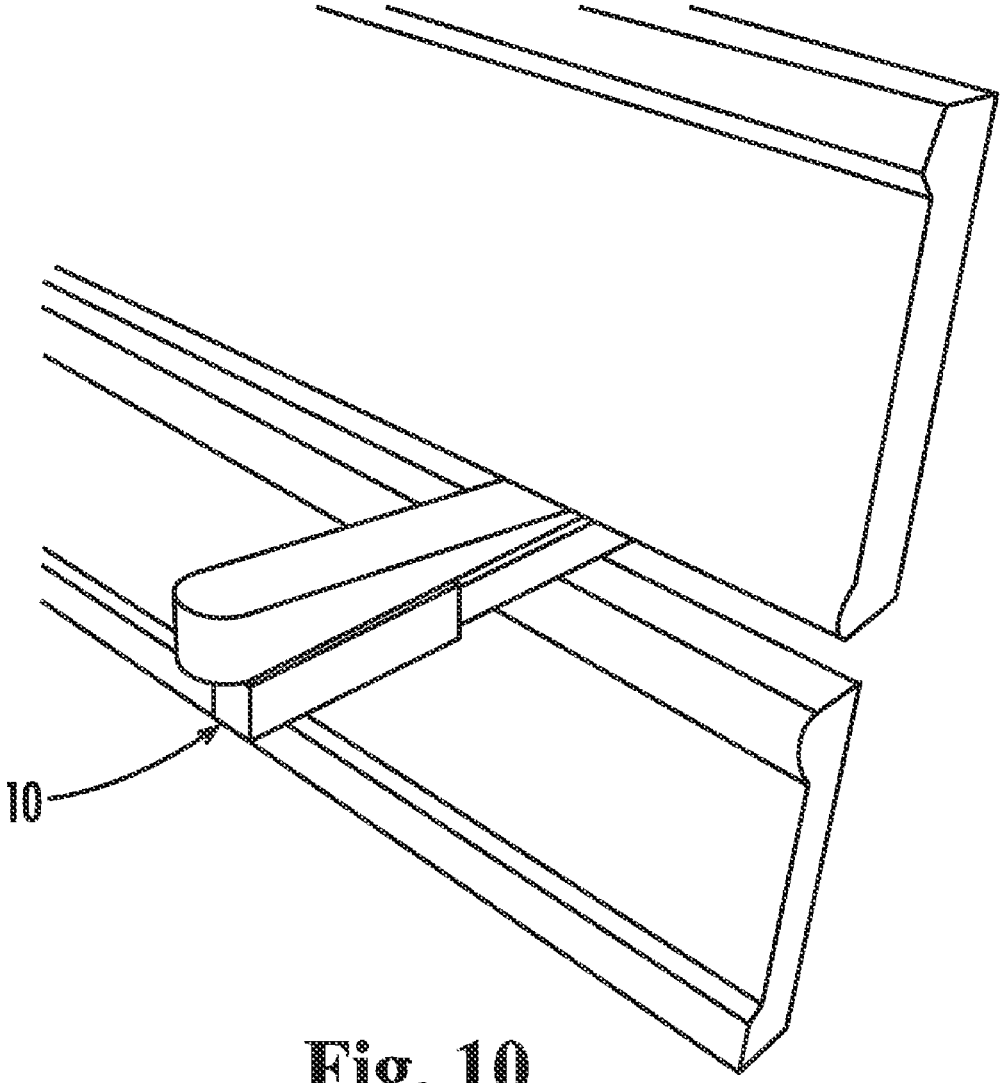
FIG. 10 shows a tile spacer according to the inventive subject matter with a standard adjustment wedge.
Figure 11:
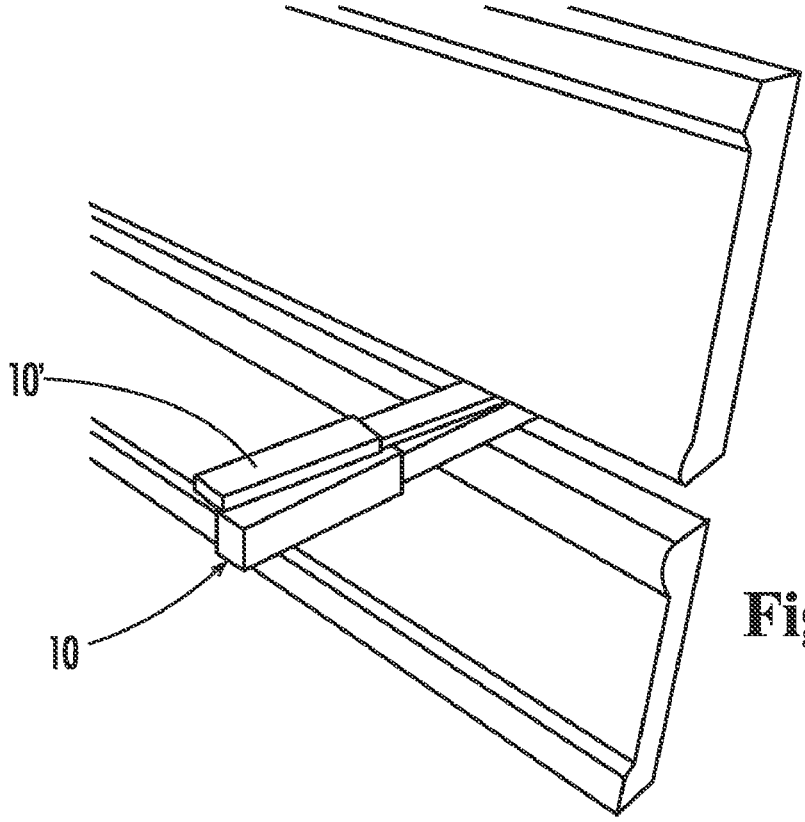
FIG. 11 shows two tile spacers according to the inventive subject matter used together.
Figure 12:
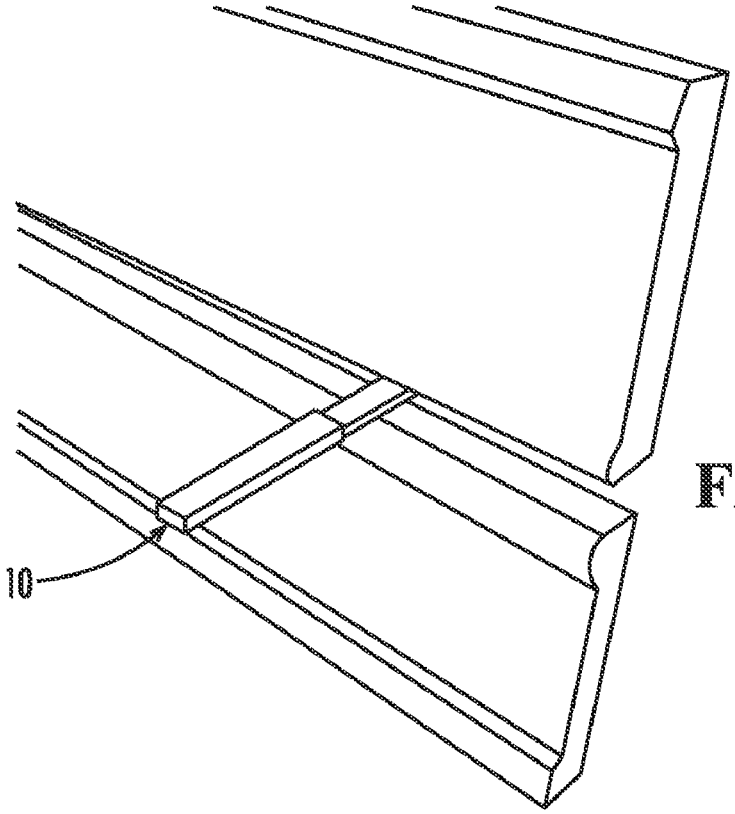
FIG. 12 shows a narrow dimensioned example of a tile spacer according to the inventive subject matter.
Figure 13:
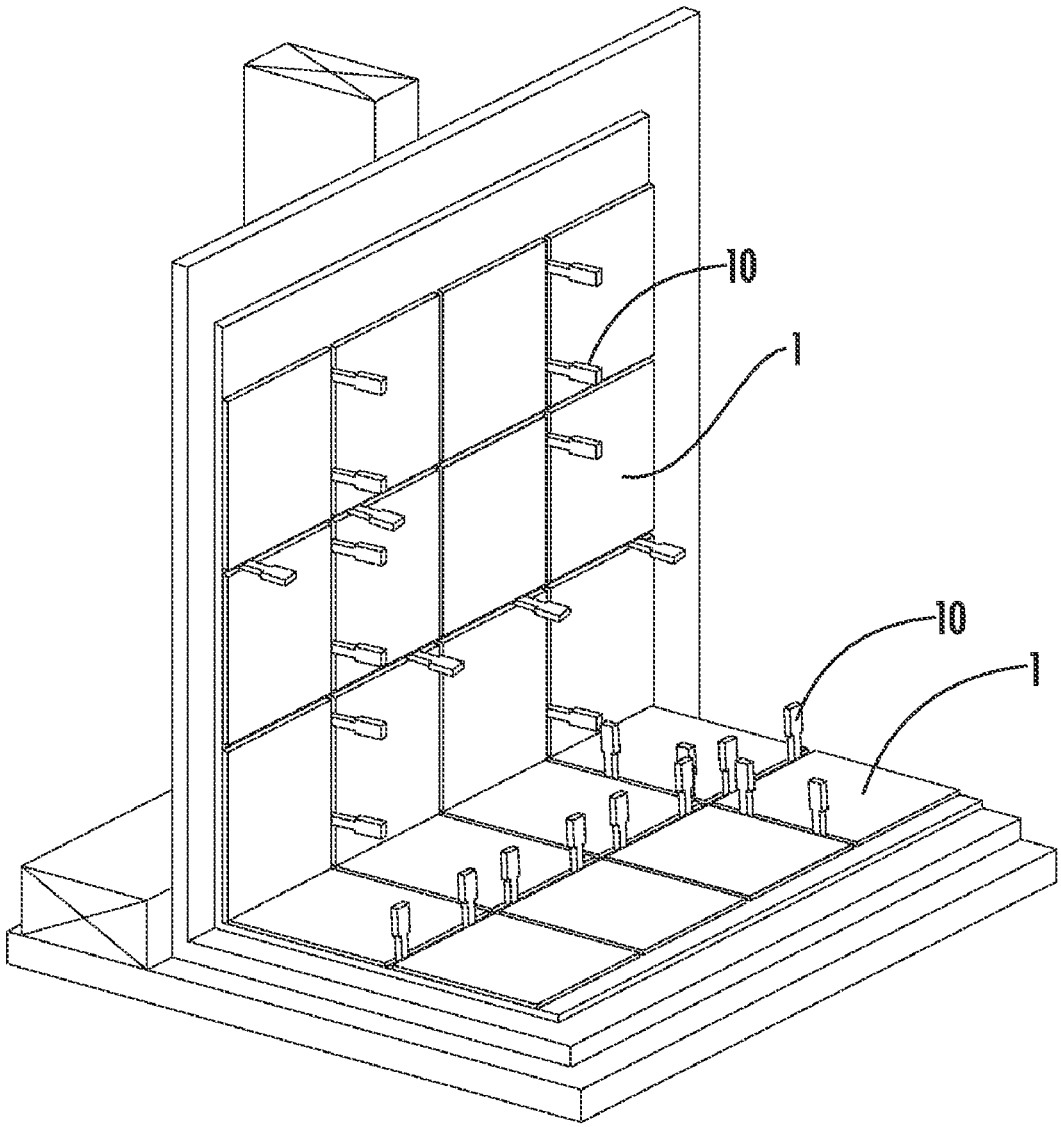
FIG. 13 shows tile spacers arranged for use in spacing wall and/or floor tiles according to the inventive subject matter.
Figure 14:
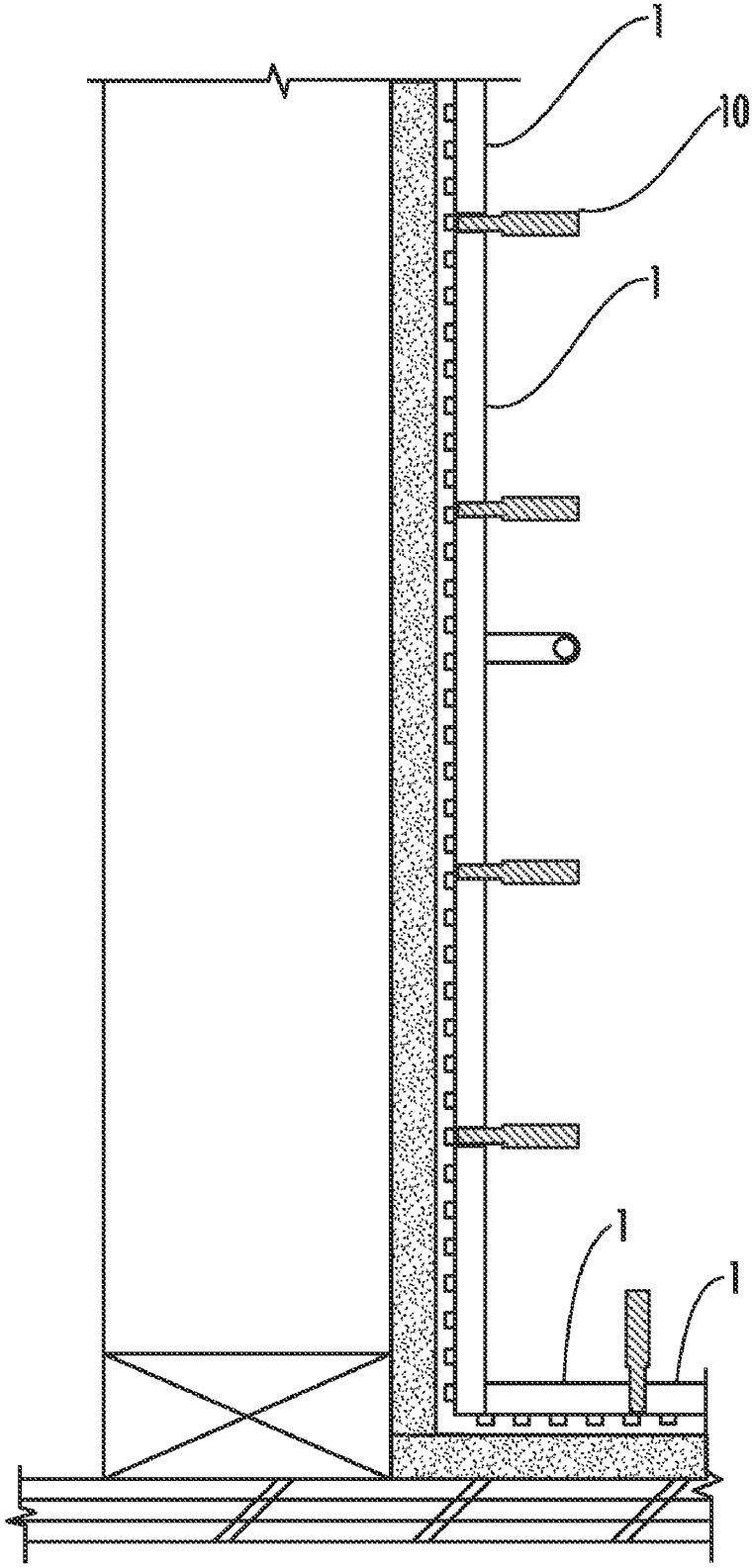
FIG. 14 shows a cross-section of the wall and floor of FIG. 13 according to the inventive subject matter.

The tile spacer according to the inventive subject matter may include sizing for adjustments, and not just grout line widths. For example, a spacer with a 5/16" arm might include other arms providing 1/4" and 3/8" spacing, to provide incremental adjustments above and below the standard size of 5/16". Further, any one of these spacers may also be used with a traditional wedge or another of the inventive spacers of different dimensions to offer additional adjustment options (FIGS. 10, 11). Very narrow size spacers are particularly useful when non-sanded grout is required (FIG. 12).

These tile spacers according to the inventive subject matter can be used with any form of tile, including ceramic tile, slate, quarry tile, and various other natural stone tiles.

As used herein, the term "grout line" means a line of a predetermined width separating adjacent rows or columns of tiles, which may or may not be filled with a mortar or other filler.

U.S. Pat. No. 6,354,058, by Christopher Lewis, granted Mar. 12, 2002, entitled "Method and Apparatus for Laying Tile," is hereby incorporated by reference.

Persons skilled in the art will recognize that many modifications and variations are possible in the details, materials, and arrangements of the parts and actions which have been described and illustrated in order to explain the nature of this inventive concept and that such modifications and variations do not depart from the spirit and scope of the teachings and claims contained therein.

The invention claimed is:

1. A tile spacer, comprising:

opposing first and second arms aligned along a common axis;

each arm having four sides arranged along and parallel to the common axis;

each arm defining predetermined, uniform spacings for tiles along its sides, the uniform spacing extending from an end of each arm to a central portion of the tile spacer where the two opposing arms join;

one arm providing spacing to provide incremental adjustments above and below a standard size; and wherein the spacer includes at least two sensory indicia, each on portions representing different spacings between tiles.

2. A tile spacer, comprising:

opposing first and second arms aligned along a common axis;

each arm having four sides arranged along and parallel to the common axis;

each arm having dimensions defining at least two different predetermined, uniform spacings along its sides for spacing grout lines between two tiles, the uniform spacing extending from an end of each arm to a central portion of the tile spacer where the two opposing arms join;

wherein the different spacings for each arm are oriented at 90 degrees of rotation of a side around the common axis;

wherein the two uniform spacings for one arm are both different from either of the different uniform spacings for the other arm;

wherein the arms are dimensioned for grasping between fingers and finger manipulation; and wherein the spacer includes at least two sensory indicia, each on portions representing different spacings between tiles.

3. A tile spacer, comprising:

opposing first and second arms aligned along a common axis;

each arm having four sides arranged along and parallel to the common axis;

each arm having dimensions defining at least two different predetermined, uniform spacings along its sides for spacing grout lines between two tiles, the uniform spacing extending from an end of each arm to a central portion of the tile spacer where the two opposing arms join;

wherein the different spacings for each arm are oriented at 90 degrees of rotation of a side around the common axis;

wherein the two uniform spacings for one arm are both different from either of the different uniform spacings for the other arm; and wherein the arms are dimensioned for grasping between fingers and finger manipulation; and wherein the predetermined spacings are selected from the spacings group of 1/32", 1/16" 1/8", 3/16", 1/4", 5/16", 3/8", and 1/2".

4. The tile spacer of claim 2 or 3 wherein the tile spacer comprises a material that is sufficiently rigid to withstand compression by the tiles with which it is intended for use.

5. The tile spacer of claim 2 or 3 wherein the first and second arms are disposed along a common axis and there are no other arms.

6. The tile spacer of claim 5 wherein the tile spacer provides at least two predetermined spacings selected from the spacings group of 1/32", 1/16" 1/8", 3/16", 1/4", 5/16", 3/8", and 1/2".

7. The tile spacer of claim 6 wherein the tile spacer provides three to four of the predetermined spacings selected from the spacings group of 1/32", 1/16" 1/8", 3/16", 1/4", 5/16", 3/8", and 1/2".

8. The tile spacer of claim 2 or 3, wherein the tile spacer comprises a non-cross-shaped polygon that provides at least two different dimensions for establishing a spacing between tiles.

9. The tile spacer of claim 8 wherein the tile spacer provides at least three dimensions for establishing a spacing between tiles.

10. The tile spacer of claim 2 or 3, wherein the tile spacer comprises an octahedron having opposing quadrihedrons.

11. The tile spacer of claim 2 wherein the predetermined spacings are selected from the spacings group of 1/32", 1/16" 1/8", 3/16", 1/4", 5/16", 3/8", and 1/2".

12. A kit comprising a set of tile spacers of differing configurations, including at least one tile spacer as claimed in claim 2 or 3.

13. The tile spacer of claim 2 or 3 wherein the spacer includes at least two sensory indicia, each on portions representing different spacings between tiles.

14. A tile spacer, comprising:

opposing first and second arms aligned along a common axis;

each arm having four sides arranged along and parallel to the common axis;

each arm defining predetermined, uniform spacings for tiles along its sides, the uniform spacing extending from an end of each arm to a central portion of the tile spacer where the two opposing arms join;

one arm providing spacing to provide incremental adjustments above and below a standard size; and wherein the predetermined spacings are selected from the spacings group of 1/32", 1/16" 1/8", 3/16", 1/4", 5/16", 3/8", and 1/2".

* * * * *